US008983356B2

(12) United States Patent
Liu et al.

(10) Patent No.: US 8,983,356 B2
(45) Date of Patent: Mar. 17, 2015

(54) IMAGE FORMING APPARATUS

(71) Applicant: Xerox Corporation, Norwalk, CT (US)

(72) Inventors: Yu Liu, Mississauga (CA); Nan-Xing Hu, Oakville (CA); Sarah J. Vella, Milton (CA)

(73) Assignee: Xerox Corporation, Norwalk, CT (US)

( * ) Notice: Subject to any disclaimer, the term of this patent is extended or adjusted under 35 U.S.C. 154(b) by 97 days.

(21) Appl. No.: 13/757,336

(22) Filed: Feb. 1, 2013

(65) Prior Publication Data

US 2014/0219679 A1 Aug. 7, 2014

(51) Int. Cl.
*G03G 21/00* (2006.01)
*G03G 15/02* (2006.01)

(52) U.S. Cl.
CPC ..... *G03G 15/025* (2013.01); *G03G 21/0094* (2013.01)
USPC ..... 399/346

(58) Field of Classification Search
USPC ..... 399/100, 159, 176, 346
See application file for complete search history.

(56) References Cited

U.S. PATENT DOCUMENTS

| | | | |
|---|---|---|---|
| 3,121,006 | A | 2/1964 | Middleton et al. |
| 4,387,980 | A | 6/1983 | Ueno et al. |
| 4,435,074 | A | 3/1984 | Midorikawa et al. |
| 4,464,450 | A | 8/1984 | Teuscher |
| 4,587,189 | A | 5/1986 | Hor et al. |
| 4,664,995 | A | 5/1987 | Horgan et al. |
| 4,921,773 | A | 5/1990 | Melnyk et al. |
| 5,069,993 | A | 12/1991 | Robinette et al. |
| 5,384,929 | A | 1/1995 | Smith |
| 5,499,089 | A | 3/1996 | Tsukamoto et al. |
| 5,646,718 | A | 7/1997 | Suwa et al. |
| 5,756,245 | A | 5/1998 | Esteghamatian et al. |
| 6,035,157 | A | 3/2000 | Takahashi et al. |
| 6,434,357 | B1 | 8/2002 | Maul et al. |
| 6,582,222 | B1 | 6/2003 | Chen et al. |
| 6,869,918 | B2 | 3/2005 | Cornelius |

(Continued)

FOREIGN PATENT DOCUMENTS

JP 2002357983 A 12/2002

OTHER PUBLICATIONS

U.S. Appl. No. 13/426,836, Ex Parte Quayle Action dated Mar. 20, 2014, XRX-0078, 18 pages.

(Continued)

*Primary Examiner* — G. M. Hyder
(74) *Attorney, Agent, or Firm* — Hoffman Warnick LLC

(57) ABSTRACT

There is described an image forming apparatus that includes an imaging member having a charge retentive-surface for developing an electrostatic latent image thereon. The imaging member includes a substrate and photoconductive member disposed on the substrate. The image forming apparatus includes a charging unit for applying an electrostatic charge on the imaging member to a predetermined electric potential wherein the charging unit is spaced from the photoconductive member a distance of from about 3 μm to about 300 μm. The image forming apparatus includes a delivery member in contact with the surface of the photoconductive member. The delivery member includes an elastomeric matrix impregnated with a liquid lubricant wherein the delivery member applies a layer of liquid lubricant to the surface of the photoconductor wherein in the layer has a thickness of from about 1 nm to about 15 nm during steady state operation.

20 Claims, 7 Drawing Sheets

(56) References Cited

U.S. PATENT DOCUMENTS

| | | | | |
|---|---|---|---|---|
| 7,103,301 | B2 | 9/2006 | Watanabe et al. | |
| 7,428,402 | B2 | 9/2008 | Hays et al. | |
| 7,505,728 | B2 | 3/2009 | Yamaguchi et al. | |
| 7,526,243 | B2 | 4/2009 | Zaman et al. | |
| 7,580,655 | B2 | 8/2009 | Nukada et al. | |
| 7,734,242 | B2 | 6/2010 | Hatakeyama et al. | |
| 7,877,054 | B1 | 1/2011 | Thayer et al. | |
| 7,881,651 | B2 | 2/2011 | Watanabe | |
| 7,960,082 | B2 | 6/2011 | Aziz et al. | |
| 7,986,910 | B2 | 7/2011 | Kabata et al. | |
| 8,080,096 | B2 | 12/2011 | Yamashita et al. | |
| 8,081,916 | B2 | 12/2011 | Tanaka et al. | |
| 8,208,835 | B2 | 6/2012 | Kabata et al. | |
| 8,600,281 | B2 | 12/2013 | Hu et al. | |
| 2002/0081128 | A1* | 6/2002 | Shakuto et al. | 399/159 |
| 2003/0049555 | A1 | 3/2003 | Sakon et al. | |
| 2003/0118372 | A1 | 6/2003 | Kitano et al. | |
| 2005/0163527 | A1 | 7/2005 | Tombs | |
| 2005/0191099 | A1* | 9/2005 | Yamaguchi et al. | 399/346 |
| 2009/0087213 | A1 | 4/2009 | Takaya et al. | |
| 2009/0162092 | A1 | 6/2009 | Hoshio | |
| 2009/0185821 | A1 | 7/2009 | Iwamoto et al. | |
| 2009/0220876 | A1 | 9/2009 | De Jong et al. | |
| 2010/0034570 | A1 | 2/2010 | Hatakeyama et al. | |
| 2010/0183972 | A1 | 7/2010 | Hasegawa et al. | |
| 2010/0189461 | A1 | 7/2010 | Shintani et al. | |
| 2011/0033798 | A1 | 2/2011 | Kim et al. | |
| 2011/0076075 | A1 | 3/2011 | Arai et al. | |
| 2011/0217101 | A1 | 9/2011 | Okamoto et al. | |
| 2011/0229195 | A1 | 9/2011 | Matsuura | |
| 2012/0063825 | A1 | 3/2012 | Hasegawa et al. | |
| 2012/0201585 | A1* | 8/2012 | Hu et al. | 399/346 |
| 2013/0101327 | A1* | 4/2013 | Vella et al. | 399/346 |
| 2013/0251432 | A1* | 9/2013 | Vella et al. | 399/346 |

OTHER PUBLICATIONS

U.S. Appl. No. 13/437,472, Notice of Allowance & Fees Due, Mar. 31, 2014, 7 pages.
U.S. Appl. No. 13/326,414, Office Action, Mar. 28, 2014, 19 pages.
U.S. Appl. No. 13/192,252, filed Jul. 27, 2011.
U.S. Appl. No. 13/192,215, filed Jul. 27, 2011.
U.S. Appl. No. 13/020,738, filed Feb. 3, 2011.
U.S. Appl. No. 12/845,662, filed Jul. 28, 2010.
U.S. Appl. No. 13/286,905, filed Nov. 1, 2011.
U.S. Appl. No. 13/533,475, Notice of Allowance and Fees Due, XRX-0081, Dec. 9, 2013, 20 pages.
U.S. Appl. No. 13/437,472, Office Action, XRX-0075, Dec. 20, 2013, 18 pages.
Walsh, U.S. Appl. No. 13/279,981, Office Action dated Nov. 6, 2013, XRX-0059, 20 pages.
Sanghera, U.S. Appl. No. 13/354,022, Office Action dated Aug. 8, 2013, (XRX-0071), 25 pages.
U.S. Appl. No. 13/426,836, Notice of Allowance and Fees Due dated May 15, 2014.

* cited by examiner

IMAGE FORMING APPARATUS

BACKGROUND

1. Field of Use

This disclosure is generally directed to an image forming apparatus having a non-contact charging roller for applying charge to the photoreceptor.

2. Background

In electrophotography or electrophotographic printing, the charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as toner. Toner is held on the image areas by the electrostatic charge on the photoreceptor surface. Thus, a toner image is produced in conformity with a light image of the original being reproduced or printed. The toner image may then be transferred to a substrate or support member (e.g., paper) directly or through the use of an intermediate transfer member, and the image affixed thereto to form a permanent record of the image to be reproduced or printed. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

The described electrophotographic copying process is well known and is commonly used for light lens copying of an original document. Analogous processes also exist in other electrophotographic printing applications such as, for example, digital laser printing and reproduction where charge is deposited on a charge retentive surface in response to electronically generated or stored images.

To charge the surface of a photoreceptor, a contact type charging device has been used; however, contact type charging devices increase wear on the photoreceptor surface and decrease the life of a photoreceptor. The contact type charging device, also termed "bias charge roll" (BCR) includes a conductive member which is supplied a voltage from a power source with a D.C. voltage superimposed with an A.C. voltage of no less than twice the level of the D.C. voltage. The charging device contacts the image bearing member (photoreceptor) surface, which is a member to be charged. The contact type charging device charges the image bearing member to a predetermined potential.

Electrophotographic photoreceptors can be provided in a number of forms. For example, the photoreceptors can be a homogeneous layer of a single material, such as vitreous selenium, or it can be a composite layer containing a photoconductive layer and another material. In addition, the photoreceptor can be layered. Multilayered photoreceptors or imaging members have at least two layers, and may include a substrate, a conductive layer, an optional undercoat layer (sometimes referred to as a "charge blocking layer" or "hole blocking layer"), an optional adhesive layer, a photogenerating layer (sometimes referred to as a "charge generation layer," "charge generating layer," or "charge generator layer"), a charge transport layer, and an optional overcoating layer in either a flexible belt form or a rigid drum configuration. In the multilayer configuration, the active layers of the photoreceptor are the charge generation layer (CGL) and the charge transport layer (CTL). Enhancement of charge transport across these layers provides better photoreceptor performance. Multilayered flexible photoreceptor members may include an anti-curl layer on the backside of the substrate, opposite to the side of the electrically active layers, to render the desired photoreceptor flatness.

To further increase the service life of the photoreceptor, use of overcoat layers has also been implemented to protect photoreceptors and improve performance, such as wear resistance. However, these low wear overcoats are associated with poor image quality due to A-zone deletion in a humid environment as the wear rates decrease to a certain level. In addition, high torque associated with low wear overcoats in A-zone also causes severe issues with BCR charging systems, such as motor failure, blade damage and contamination on the BCR and the photoreceptor. As a result, use of a low wear overcoat with BCR charging systems is still a challenge, and there is a need to find ways to increase the life of the photoreceptor.

SUMMARY

Disclosed herein is an image forming apparatus that includes an imaging member having a charge retentive-surface for developing an electrostatic latent image thereon. The imaging member includes a substrate and photoconductive member disposed on the substrate. The image forming apparatus includes a charging unit for applying an electrostatic charge on the imaging member to a predetermined electric potential wherein the charging unit is spaced from the photoconductive member a distance of from about 3 μm to about 300 μm. The image forming apparatus includes a delivery member in contact with the surface of the photoconductive member. The delivery member includes an elastomeric matrix impregnated with a liquid lubricant wherein the delivery member applies a layer of liquid lubricant to the surface of the photoconductor wherein in the layer has a thickness of from about 1 nm to about 15 nm during steady state operation.

Disclosed herein is an image forming apparatus including an imaging member having a charge retentive-surface for developing an electrostatic latent image thereon. The imaging member includes a substrate and a photoconductive member disposed on the substrate having a surface for supporting a toner image. The image forming apparatus includes a charging unit for applying an electrostatic charge on the imaging member to a predetermined electric potential wherein the charging unit is spaced from the photoconductive member a distance of from about 3 μm to about 300 μm. The image forming apparatus includes a delivery member in contact with the surface of the photoconductive member. The delivery member includes an elastomeric matrix impregnated with a liquid lubricant wherein the delivery member applies a layer of liquid lubricant to the surface of the photoconductor wherein in the layer has a thickness 1 nm to about 15 nm during steady state operation.

Disclosed herein is an image forming apparatus including an imaging member having a charge retentive-surface for developing an electrostatic latent image thereon. The imaging member includes a substrate, a photoconductive layer disposed on the substrate, a protective layer disposed on the photoconductive layer. The image forming apparatus includes a bias charge roll for applying an electrostatic charge on the imaging member to a predetermined electric potential wherein the bias charge roll is arranged to be adjacent to the photoconductive layer surface and spaced a distance from the protective layer of from 3 μm to 300 μm. The image forming apparatus includes a delivery member in contact with the protective layer, wherein the delivery member comprises an elastomeric matrix impregnated with a liquid lubricant wherein the delivery member applies a layer of liquid lubricant to the surface of the imaging member wherein the layer has a thickness of from about 1 nm to about 15 nm during steady state operation.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

It should be noted that some details of the figures have been simplified and are drawn to facilitate understanding of the embodiments rather than to maintain strict structural accuracy, detail, and scale.

DESCRIPTION OF THE EMBODIMENTS

In the following description, reference is made to the chemical formulas that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

Figure 1:
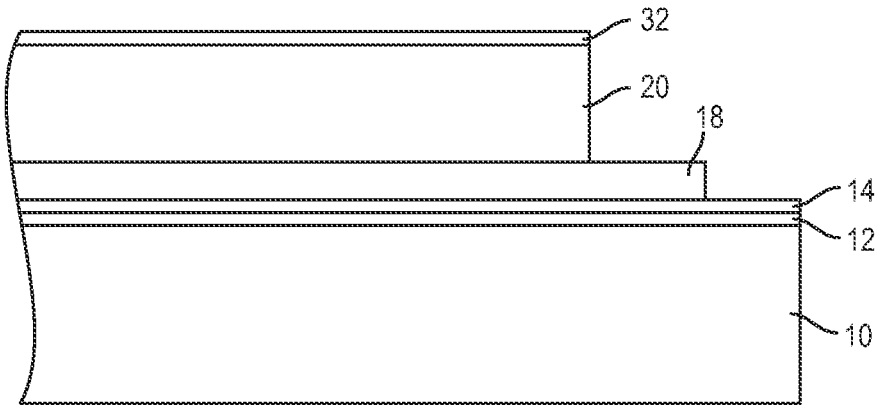
FIG. 1 is a cross-sectional view of an imaging member in a drum configuration according to the present embodiments.

FIG. 1 is an exemplary embodiment of a multilayered electrophotographic imaging member or photoreceptor having a drum configuration. The imaging member may further be in a cylinder configuration. As can be seen, the exemplary imaging member includes a rigid support substrate 10, an electrically conductive ground plane 12, an undercoat layer 14, a charge generation layer 18 and a charge transport layer 20. An optional overcoat layer 32 disposed on the charge transport layer 20 may also be included. The substrate 10 may be a material selected from the group consisting of a metal, metal alloy, aluminum, zirconium, niobium, tantalum, vanadium, hafnium, titanium, nickel, stainless steel, chromium, tungsten, molybdenum, and mixtures thereof. The substrate 10 may also comprise a material selected from the group consisting of a metal, a polymer, a glass, a ceramic, and wood.

The charge generation layer 18 and the charge transport layer 20 form an imaging layer described here as two separate layers. In an alternative to what is shown in the figure, the charge generation layer 18 may also be disposed on top of the charge transport layer 20. It will be appreciated that the functional components of these layers may alternatively be combined into a single layer.

As discussed above, an electrophotographic imaging member generally comprises at least a substrate layer, an imaging layer disposed on the substrate and an optional overcoat layer disposed on the imaging layer. In further embodiments, the imaging layer comprises a charge generation layer disposed on the substrate and the charge transport layer disposed on the charge generation layer. In other embodiments, an undercoat layer may be included and is generally located between the substrate and the imaging layer, although additional layers may be present and located between these layers. The imaging member can be employed in the imaging process of electrophotography, where the surface of an electrophotographic drum containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image. This electrostatic latent image may then be developed to form a visible image by depositing charged particles of same or opposite polarity on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

Common print quality issues are strongly dependent on the quality and interaction of these photoreceptor layers. For example, when a photoreceptor is used in combination with a contact charger and a toner obtained by chemical polymerization (polymerization toner), image quality may deteriorate due to a surface of the photoreceptor being stained with a discharge product produced in contact charging or the polymerization toner remaining after a cleaning step. Still further, repetitive cycling causes the outermost layer of the photoreceptor to experience a high degree of frictional contact with other machine subsystem components used to clean and/or prepare the photoreceptor for imaging during each cycle.

When repeatedly subjected to cyclic mechanical interactions against the machine subsystem components, a photoreceptor can experience severe frictional wear at the outermost organic photoreceptor layer surface that can greatly reduce the useful life of the photoreceptor. Ultimately, the resulting wear impairs photoreceptor performance and thus image quality. Another type of common image defect is thought to result from the accumulation of charge somewhere in the photoreceptor. Consequently, when a sequential image is printed, the accumulated charge results in image density changes in the current printed image that reveals the previously printed image. In the xerographic process spatially varying amounts of positive charges from the transfer station find themselves on the photoreceptor surface. If this variation is large enough it will manifest itself as a variation in the image potential in the following xerographic cycle and print out as a defect.

A conventional approach to photoreceptor life extension is to apply an overcoat layer with wear resistance. For bias charge roller (BCR) charging systems, overcoat layers are associated with a trade-off between A-zone deletion (i.e. an image defect occurring in A-zone: 28° C., 85% RH) and photoreceptor wear rate. For example, most organic photoconductor (OPC) materials sets require a certain level of wear rate in order to suppress A-zone deletion, thus limiting the life of a photoreceptor. One way to eliminate the wear rate problem is to provide a non-contact charging member.

Figure 2A:
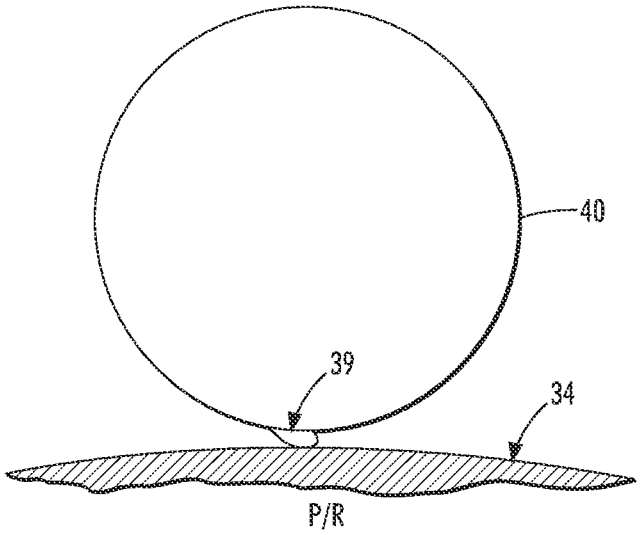
FIG. 2(*a*) is a cross-sectional view of a BCR spaced from a surface of a P/R with a solid particle lubricant on the surface of the P/R; (*b*) shows the charging potential on the surface of the P/R.
Figure 2B:
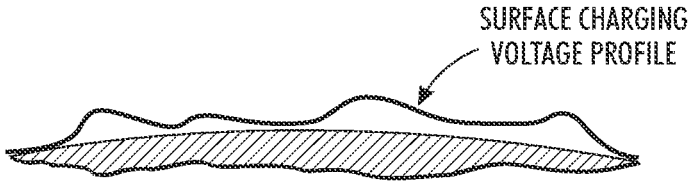

When using a non-contact bias charging member, zinc stearate powder along with other solid lubricants have been used as protective agent as described in U.S. Pat. No. 7,986,910. However, solid lubricants create other issues such as degradation of lubrication property, inefficient protection from electrostatic discharge, current leakage and streaking on the printed image. U.S. Pat. No. 7,986,910 teaches that a BCR can be spaced from a P/R drum. As shown in FIG. 2(*a*) when the BCR 40 is spaced from the surface of the P/R 34, the applied solid powder 37 protective layer on photoreceptor is un-even and causes contamination on the BCR 40 as a solid particle 37 or clumps of solid particles on the P/R 34 surface are transferred to the BCR 40. In addition, solid particle coatings increase the non-uniformity of the charging voltage on the surface of the P/R as shown in FIG. 2(*b*). In the non-contact BCR system described in U.S. Pat. No. 6,405,006, the gap between BCR and P/R belt is from about 3 μm to about 300 μm with no mention of the use of a lubricant on the P/R belt.

Described herein is an imaging apparatus that includes a liquid lubricant applicator, which delivers ultra-thin layer protective material such as paraffin on photoreceptor surface, for a non-contact BCR charging subsystem. The liquid protective layer as applied can effectively provide good lubrication and address image defects such as A-zone deletion, while avoiding any contamination to the non-contact BCR unit.

Figure 3:
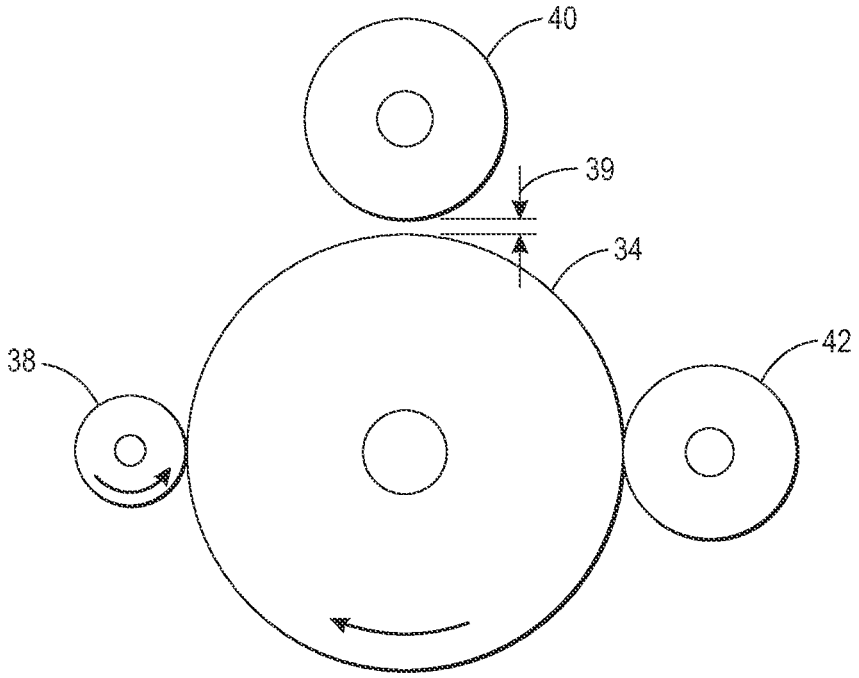
FIG. 3 is a cross-sectional view of a system implementing a delivery member according to the present embodiments.

In FIG. 3 a photoreceptor (P/R) drum 34 is shown with a bias charging roller (BCR) 40 spaced from the P/R 34. The gap 39 between the BCR 40 and the P/R 34 is from about 3 μm to about 300 μm, or from about 5 μm to about 200 μm, or from about 10 μm to about 100 μm. A delivery apparatus 38 in the form of a roller or a blade is provided to contact the P/R drum 34 surface and to apply a liquid layer of lubricant through contact pressure. FIG. 3 shows a roller 38 but a blade delivery apparatus is also suitable. The applied liquid lubricant layer is uniform without requiring a leveling blade or other accessory. Unlike solid powder as lubricant particles, the ultra-thin layer of liquid lubricant material is applied in uniformly and the liquid lubricant layer thickness can be controlled to be less than 100 nm. The thickness of liquid lubricant coating is from about 1 nm to about 15 nm, or from about 3 nm to about 12 nm, or from about 7 nm to about 10 nm. The application of a thin uniform layer of liquid lubricant allows implementation of a non-contact BCR charging system. The photoreceptor 34 is substantially uniformly charged by the BCR 40 to initiate the electrophotographic reproduction process. The charged photoreceptor is then exposed to a light image to create an electrostatic latent image on the photoreceptive member (not shown). This latent image is subsequently developed into a visible image by a toner developer 42. Thereafter, the developed toner image is transferred from the photoreceptor member through a record medium to a copy sheet or some other image support substrate to which the image may be permanently affixed for producing a reproduction of the original document (not shown).

In embodiments, the charging roller is equipped with spacers (not shown) or spacing members that are larger in their radius than the outer layer of the charging roller 40 by an amount equal to gap 39. The spacers raid on the outer edge of the P/R 34 surface where no image generation or transfer is conducted. In embodiments, the BCR is driven by a driving device to rotate the charging unit such that a direction of a circumferential velocity of the charging unit is in the same direction as a direction of circumferential velocity of the photoconductive member. The outer layer of the charging unit has a volume resistance of from about $10^3$ ohm-cm to about $10^{13}$ ohm-cm, or in embodiments, a volume resistance of from about $10^5$ ohm-cm to about $10^{12}$ ohm-cm or a volume resistance of from about $10^9$ ohm-cm to about $10^{12}$ ohm-cm.

The P/R 34 may be driven by the BCR 40 through contact with the spacing members. A driving device (not shown) rotates the BCR such that a direction of a circumferential velocity of the BCR 40 is in the same direction as a direction of circumferential velocity of the P/R 34.

The friction coefficient on the P/R with a liquid lubricant layer is reduced minimizing wear and extending the life of the P/R. The reduction in the friction coefficient using the liquid lubricant layer is from about 5 percent to about 36 percent or from about 10 percent to about 36 percent or from about 15 percent to about 36 percent.

In embodiments, a direct current (DC) voltage with superposed alternating current (AC) element is applied on the BCR to charge the P/R to provide charging uniformity.

To apply the layer of liquid lubricant materials on P/R 34 surface, an aforementioned delivery roller or blade is used. The roller or blade includes an elastomeric matrix composed of a liquid lubricant, such as paraffin cast around a support member. Using elastomeric material is beneficial as localized stress on P/R is minimized when in contact with delivery member 38. The PDMS is very robust covering wide range of different operation conditions.

Figure 4:
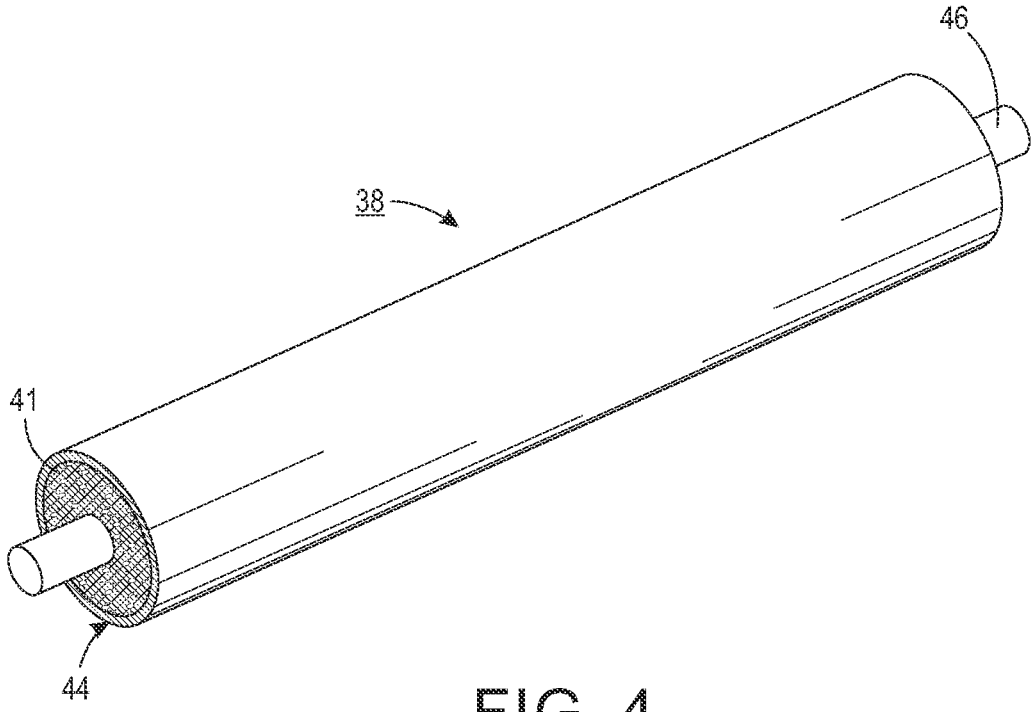
FIG. 4 is a cross-sectional view of a delivery member according to the present embodiments.
Figure 5:
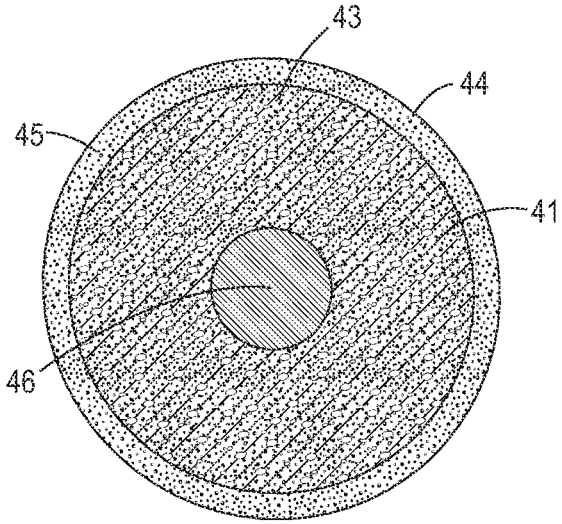
FIG. 5 is an alternative cross-sectional view of a delivery member according to the present embodiments.

The delivery apparatus 38 can be in the form of a blade or a roller. In embodiments, a delivery roller includes an outer layer having a layer that acts as a reservoir for the liquid lubricant and distributes the layer to the surface of the P/R. FIG. 4 illustrates the delivery apparatus 38 according to the present embodiments. FIG. 5 is a cross-section of the delivery member shown in FIG. 4. The delivery member 38 comprises a reservoir layer 41 and an optional outer layer 44. The reservoir layer 41 comprises an elastomeric matrix having pores or a porous material 43 of a size from about 5 microns and about 25 microns. The pores or porous material 43 contain liquid lubricant. The reservoir layer 41 is disposed around a support member 46. The optional outer layer 44 is disposed over the reservoir layer 41. The outer layer 44 is an elastomeric material that contains pores 45 having a size less than 1 μm. In embodiments, the outer layer is optional. Delivery rollers are described in U.S. Ser. No. 13/279,981, U.S. Ser.

No. 13/326,414 and U.S. Ser. No. 13/354,022 incorporated in their entirety by reference herein.

In embodiments, the support member 46 is a stainless steel rod. The support member 46 can further comprise a material selected from the group consisting of metal, metal alloy, plastic, ceramic, and glass, and mixtures thereof.

The diameter of the support member 46 and the thickness of the reservoir layer 41 may be varied depending on the application needs. In specific embodiments, the support member has a diameter of from about 3 mm to about 10 mm. In specific embodiments, the reservoir layer has a thickness of from about 20 μm to about 100 mm.

In the present embodiments, the liquid lubricant is contained in pores 43 of the reservoir layer 41 and delivered to the surface. The liquid lubricant is transferred to the surface of the P/R. There can be an optional outer layer 44. Delivery members fabricated according to the present embodiments have been shown to contain sufficient quantities of the liquid lubricant to continuously supply an ultra-thin layer of the liquid lubricant to the surface of the P/R.

Figure 6:
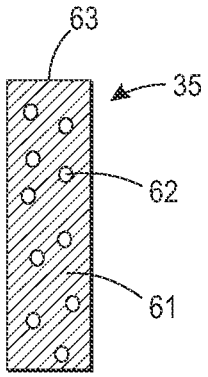
FIG. 6 is a cross-sectional view of an alternate delivery member according to the present embodiments.

In an embodiment the delivery apparatus 38 can be a blade applicator 35 shown in FIG. 6, the components of the system comprising the blade applicator 35 include single layer 63 of an elastomeric matrix 61 having pores or a porous material 62. The functional material is dispersed in the pores or the porous material 62 of layer 63. In embodiments, the blade applicator 35 includes a porous material rather than pores 42 to hold the functional material.

Figure 7:
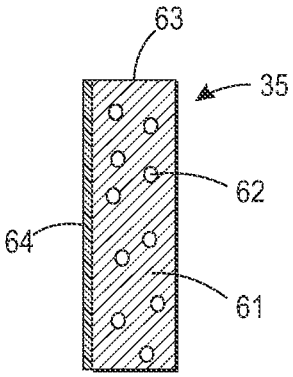
FIG. 7 is a cross-sectional view of an alternate delivery member according to the present embodiments.

In an embodiment of the blade applicator shown in FIG. 7 there is a second layer 64 formed of an elastomeric material to meter the functional material to the surface of the P/R or BCR. The layer 64 is in a trailing position to the surface of the P/R 34. The layer 64 is disposed on layer 63. In FIG. 7 the blade applicator 35 includes a layer 63 and an elastomeric matrix 61 having pores or a porous material 62. The functional material is dispersed in the pores or the porous material 62 of layer 63. In embodiments, the blade applicator 35 can include a porous material rather than pores to hold the functional material. Blade applicators are described in U.S. Ser. No. 13/437,472 incorporated in its entirety by reference herein.

In embodiments, the reservoir layer of the delivery roller may be comprised of a polymer selected from the group consisting of silicones, polyurethanes, polyesters, fluoro-silicones, polyolefin, fluoroelastomers, synthetic rubber, natural rubber, and mixtures thereof.

In embodiments, the outer layer of the delivery roller is a polymer selected from the group consisting of polysiloxane, silicones, polyurethane, polyester, fluoro-silicone, polyolefin, fluoroelastomer, synthetic rubber, natural rubber and mixtures thereof.

In embodiments, the liquid lubricant can be an organic or inorganic compound, oligomer or polymer, or a mixture thereof. Illustrative examples of liquid lubricants may include, for example, a liquid material selected from the group consisting of hydrocarbons, fluorocarbons, mineral oil, synthetic oil, natural oil, and mixtures thereof. The liquid lubricants may further contain a functional group that facilitates adsorption of the liquid lubricants on the photoreceptor surface, and optionally a reactive group that can chemically modify the photoreceptor surface. For example, the liquid lubricants may comprise paraffin, alkanes, fluoroalkanes, alkyl silanes, fluoroalkyl silanes alkoxy-silanes, siloxanes, glycols or polyglycols, mineral oil, synthetic oil, natural oil or mixture thereof.

In embodiments, the liquid lubricant comprises both a liquid hydrophobic material and an anti-oxidant. The liquid lubricant comprises a liquid lubricant and an anti-oxidant that is soluble in the liquid.

An anti-oxidant that demonstrated both solubility and high loading into the paraffin oil was 2,6-di-tert-butyl-4-methyl phenol. The maximum loading of 2,6-di-tert-butyl-4-methyl phenol in paraffin oil is approximately 50 weight percent.

In embodiments, the delivery member is an elastomeric material cast around the support member by use of a mold. Thereafter, the elastomeric matrix is cured. The reservoir layer is impregnated with the liquid lubricant, such as paraffin. After curing, the elastomeric matrix containing the liquid lubricant is extracted from the mold.

If an outer layer is used on the delivery roller or blade applicator, the outer layer is prepared by mixing a cross-linkable elastomeric polymer and then casting the mixture onto the reservoir layer by use of a mold. The elastomeric material is then cured to form the delivery member.

In a specific embodiment, the reservoir layer contains 2,6-di-tert-butyl-4-methyl phenol dissolved in paraffin oil, with the paraffin solution dispersed in a s silicone matrix and cast around the support member. The reservoir layer (paraffin and 2,6-di-tert-butyl-4-methyl phenol in silicone) is prepared by, i) dissolving 2,6-di-tert-butyl-4-methyl phenol in paraffin, ii) mixing the solution into a cross-linkable polydimethylsiloxane (PDMS) and then, iii) casting the mixture onto the support member by use of a mold. Thereafter, the PDMS is cured. After curing, the PDMS coated rod is extracted from the mold. Alternatively, the reservoir layer can be impregnated by immersing cured PDMS in a solution of the liquid lubricant, (such as paraffin and 2,6-di-tert-butyl-4-methyl phenol). If an optional outer layer is needed, the outer layer is prepared by mixing a cross-linkable polydimethylsiloxane (PDMS) and then casting the mixture onto the reservoir layer by use of a mold. In embodiments, the liquid cross-linkable PDMS is prepared from a two-component system, namely, a base agent and a curing agent. In further embodiments, the base agent and curing agent are present in a weight ratio of from about 50:1 to 2:1, or from about 20:1 to about 5:1 in both the reservoir and outer layers. In embodiments, the weight ratio of the liquid lubricant to the elastomeric material of the reservoir layer 42 is at a weight ratio of from about 1:10 to about 1:1, or from about 1:8 to about 1:1.5 or from about 1:7 to about 1:2.

A long life photoreceptor (P/R) enables significant cost reduction. Generally P/R life extension is achieved with a wear-resistant overcoat. However, wear resistant overcoats are associated with an increase in A-zone deletion (a printing defect that occurs at high humidity). Most organic photoreceptor materials require a minimal wear rate of 2 nm/Kcycle (Scorotron charging system) or from about 5 nm/Kcycle to about 10 nm/Kcycle (BCR charging system) in order to suppress A-zone deletion. In addition, wear-resistant overcoats cause a higher torque that results in issues with BCR (bias charging roller) charging systems, such as motor failure and blade damage (which results in streaking of toner in prints). By configuring the electrostatic apparatus so that the BCR does not contact the P/R, the need protective overcoat on the imaging member is minimized; however, in embodiments a protective overcoat is desired.

The description below describes embodiments of photoconductors.

The Overcoat Layer

Other layers of the imaging member may include, for example, an optional over coat layer 32. An optional overcoat layer 32, if desired, may be disposed over the charge transport layer 20 to provide imaging member surface protection as well as improve resistance to abrasion. In embodiments, the overcoat layer 32 may have a thickness ranging from about 0.1 micrometer to about 15 micrometers or from about 1 micrometer to about 10 micrometers, or in a specific embodiment, about 3 micrometers to about 10 micrometers. These overcoating layers typically comprise a charge transport component and an optional organic polymer or inorganic polymer. These overcoating layers may include thermoplastic organic polymers or cross-linked polymers such as thermosetting resins, UV or e-beam cured resins, and the likes. The overcoat layers may further include a particulate additive such as metal oxides including aluminum oxide and silica, or low surface energy polytetrafluoroethylene (PTFE), and combinations thereof. Any known or new overcoat materials may be included for the present embodiments. In embodiments, the overcoat layer may include a charge transport component or a cross-linked charge transport component.

The Substrate

The photoreceptor support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed, such as for example, metal or metal alloy. Electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate can be a single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a conductive ground plane 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The thickness of the substrate 10 depends on numerous factors, including flexibility, mechanical performance, and economic considerations. The thickness of the support substrate 10 of the present embodiments may be at least about 500 micrometers, or no more than about 3,000 micrometers, or be at least about 750 micrometers, or no more than about 2500 micrometers.

The Ground Plane

The electrically conductive ground plane 12 may be an electrically conductive metal layer which may be formed, for example, on the substrate 10 by any suitable coating technique, such as a vacuum depositing technique. Metals include aluminum, zirconium, niobium, tantalum, vanadium, hathium, titanium, nickel, stainless steel, chromium, tungsten, molybdenum, and other conductive substances, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be at least about 20 Angstroms, or no more than about 750 Angstroms, or at least about 50 Angstroms, or no more than about 200 Angstroms for an optimum combination of electrical conductivity, flexibility and light transmission.

The Hole Blocking Layer

After deposition of the electrically conductive ground plane layer, the hole blocking layer 14 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethylethylamino) titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl)methyl diethoxysilane, and $[H_2N(CH_2)_3]CH_3Si(OCH_3)_2$ (gamma-aminopropyl)methyl diethoxysilane.

The Charge Generation Layer

The charge generation layer 18 may thereafter be applied to the undercoat layer 14. Any suitable charge generation binder including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film forming polymeric binder. Selenium, selenium alloy, benzimidazole perylene, and the like and mixtures thereof may be formed as a continuous, homogeneous charge generation layer.

The Charge Transport Layer

In a drum photoreceptor, the charge transport layer comprises a single layer of the same composition. As such, the charge transport layer will be discussed specifically in terms of a single layer 20, but the details will be also applicable to an embodiment having dual charge transport layers. The charge transport layer 20 is thereafter applied over the charge generation layer 18 and may include any suitable transparent organic polymer or non-polymeric material capable of supporting the injection of photogenerated holes or electrons from the charge generation layer 18 and capable of allowing the transport of these holes/electrons through the charge transport layer to selectively discharge the surface charge on the imaging member surface. In one embodiment, the charge transport layer 20 not only serves to transport holes, but also protects the charge generation layer 18 from abrasion or chemical attack and may therefore extend the service life of the imaging member. The charge transport layer 20 can be a substantially non-photoconductive material, but one which supports the injection of photogenerated holes from the charge generation layer 18.

The Adhesive Layer

An optional separate adhesive interface layer may be provided in certain configurations, such as for example, in flexible web configurations. In the embodiment illustrated in FIG. 1, the interface layer would be situated between the blocking layer 14 and the charge generation layer 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interface layer may be applied directly to the hole blocking layer 14. Thus, the adhesive interface layer in embodiments is in direct contiguous contact with both the underlying hole blocking layer 14 and the overlying charge generator layer 18 to enhance adhesion bonding to provide linkage. In yet other embodiments, the adhesive interface layer is entirely omitted.

The adhesive interface layer may have a thickness of at least about 0.01 micrometers, or no more than about 900 micrometers after drying. In embodiments, the dried thickness is from about 0.03 micrometers to about 1 micrometer.

The Ground Strip

The ground strip may comprise a film forming polymer binder and electrically conductive particles. Any suitable electrically conductive particles may be used in the electrically conductive ground strip layer 19. The ground strip 19 may comprise materials which include those enumerated in U.S. Pat. No. 4,664,995. Electrically conductive particles include carbon black, graphite, copper, silver, gold, nickel, tantalum, chromium, zirconium, vanadium, niobium, indium tin oxide and the like. The electrically conductive particles may have any suitable shape. Shapes may include irregular, granular, spherical, elliptical, cubic, flake, filament, and the like. The electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness of at least about 7 micrometers, or no more than about 42 micrometers, or of at least about 14 micrometers, or no more than about 27 micrometers.

Various exemplary embodiments encompassed herein include a method of imaging which includes generating an electrostatic latent image on an imaging member, developing a latent image, and transferring the developed electrostatic image to a suitable substrate.

While embodiments have been illustrated with respect to one or more implementations, alterations and/or modifications can be made to the illustrated examples without departing from the spirit and scope of the appended claims. In addition, while a particular feature herein may have been disclosed with respect to only one of several implementations, such feature may be combined with one or more other features of the other implementations as may be desired and advantageous for any given or particular function.

EXAMPLES

The following experiments parameters were conducted to show a layer of liquid lubricant can be applied to the surface of a P/R in a repeatable manner.

Photoreceptor

A coating solution for an undercoat layer comprising 100 parts of a zirconium compound (trade name: Orgatics ZC540), 10 parts of a silane compound (trade name: A110, manufactured by Nippon Unicar Co., Ltd), 400 parts of isopropanol solution and 200 parts of butanol was prepared. The coating solution was applied onto a 40-mm cylindrical aluminum (Al) substrate subjected to honing treatment by dip coating, and dried by heating at 150° C. for 10 minutes to form an undercoat layer having a film thickness of 0.1 microns. A 0.5 micron thick charge generating layer was subsequently dip coated on top of the undercoat layer from a dispersion of Type V hydroxygallium phthalocyanine (12 parts), alkylhydroxy gallium phthalocyanine (3 parts), and a vinyl chloride/vinyl acetate copolymer, VMCH (Mn=27,000, about 86 weight percent of vinyl chloride, about 13 weight percent of vinyl acetate and about 1 weight percent of maleic acid available from Dow Chemical (10 parts), in 475 parts of n-butylacetate. Subsequently, a 20 μm thick charge transport layer (CTL) was dip coated on top of the charge generating layer from a solution of N,N'-diphenyl-N,N'-bis(3-methylphenyl)-1,1'-biphenyl-4,4'-diamine (82.3 parts), 2.1 parts of 2,6-di-tert-butyl-4-methylphenol (BHT) from Aldrich and a polycarbonate, PCZ-400 [poly(4,4'-dihydroxy-diphenyl-1-1-cyclohexane), Mw=40,000] available from Mitsubishi Gas Chemical.Company, Ltd. (123.5 parts) in a mixture of 546 parts of tetrahydrofuran (THF) and 234 parts of monochlorobenzene. The CTL was dried at 115° C. for 60 minutes. An overcoat coating solution was prepared from a mixture of N,N,N',N'-tetrakis-[(4-hydroxymethyl)phenyl]-biphenyl-4,4'-diamine (3.22 g parts), N,N'-diphenyl-N,N'-bis-(3-hydroxyphenyl)-biphenyl-4,4'-diamine (7.98 g parts), melamine-formaldehyde resin (2.10 parts), a silicone leveling agent (0.5 parts), an anti-oxidant (0.4 part), and an acid catalyst (0.65 part) in a solvent of 1-methoxy-2-propanol (40.3 parts). The mixture was mixed on a rolling wave rotator for 10 min and then heated at 50° C. for 65 minutes until a homogenous solution resulted, then cooled to room temperature. After filtering with a 1-μm PTFE filter, the solution was applied onto the photoreceptor surface and more specifically onto the charge transport layer using cup coating technique, followed by thermal curing at 155° C. for 40 minutes to form an overcoat layer having a film thickness of 6 μm.

Liquid Lubricant Delivery Member

A single layer delivery roller was prepared using a liquid paraffin-impregnated silicone polymer. The liquid paraffin-impregnated silicone layer was prepared by mixing paraffin oil into a cross-linkable, liquid polydimethylsiloxane (PDMS) before curing the PDMS polymer. The mixture (PDMS/paraffin oil) was cast onto the mandrel using a cylindrical mold, followed by curing. After curing, the PDMS/paraffin coated rod was extracted from the mold. The ratio of liquid paraffin to PDMS was about 4:1.

Figure 8:
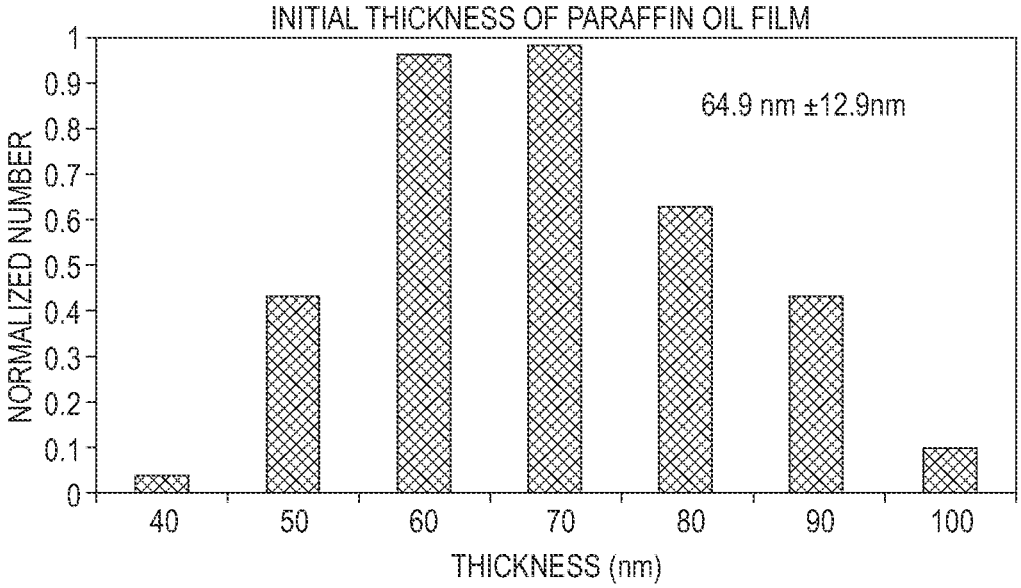
FIG. 8 shows the thickness of the liquid lubricant layer on P/R surface using a delivery member that had been idle for 4 days.
Figure 9:
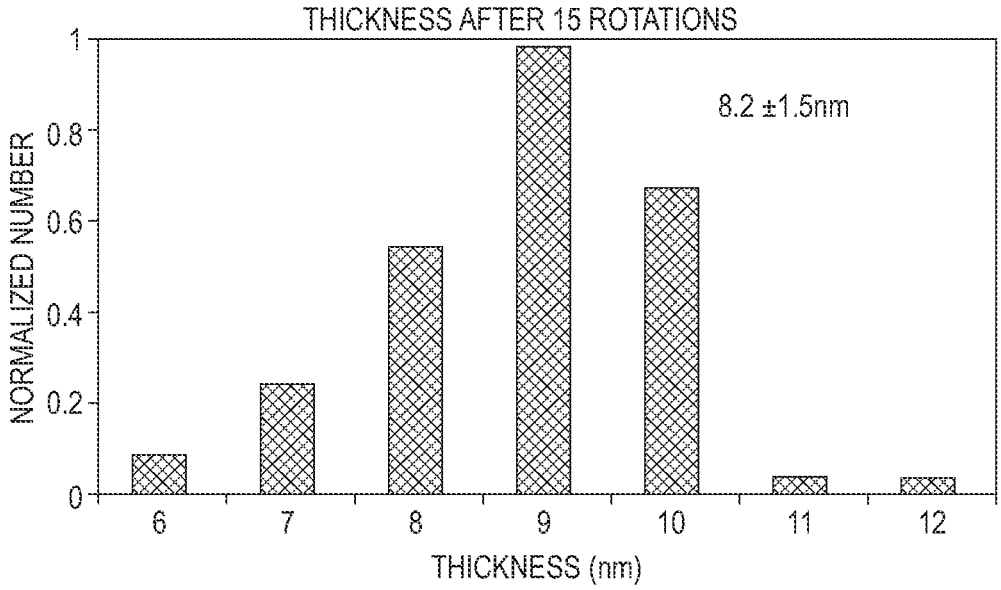
FIG. 9 shows the thickness of the liquid lubricant layer on P/R surface after 15 rotations using a delivery member according to the present embodiments.

Atomic force microscopy (AFM) was used for measuring thickness of the liquid lubricant. A scanning area with size 30 um×30 um was randomly chosen on the photoreceptor. One hundred (100) sample points were randomly selected from the scanning area and the thickness of the liquid lubricant layer was measured. Five different scanning areas for a total of 500 points were captured for a sample. The results of the liquid lubricant layer thickness is shown in FIG. 8 for the liquid lubricant delivery member that had been idle for four days. FIG. 9 shows the results for of the roller after 15 full rotations of the delivery roller. As shown in the FIG. 8, the initial liquid lubricant thickness on the P/R was about 65 nm plus or minus 13 nm. After the 15 full rotations the thickness of the lubricant layer was about 8.4 nm plus or minus 1.5 nm.

Figure 10:
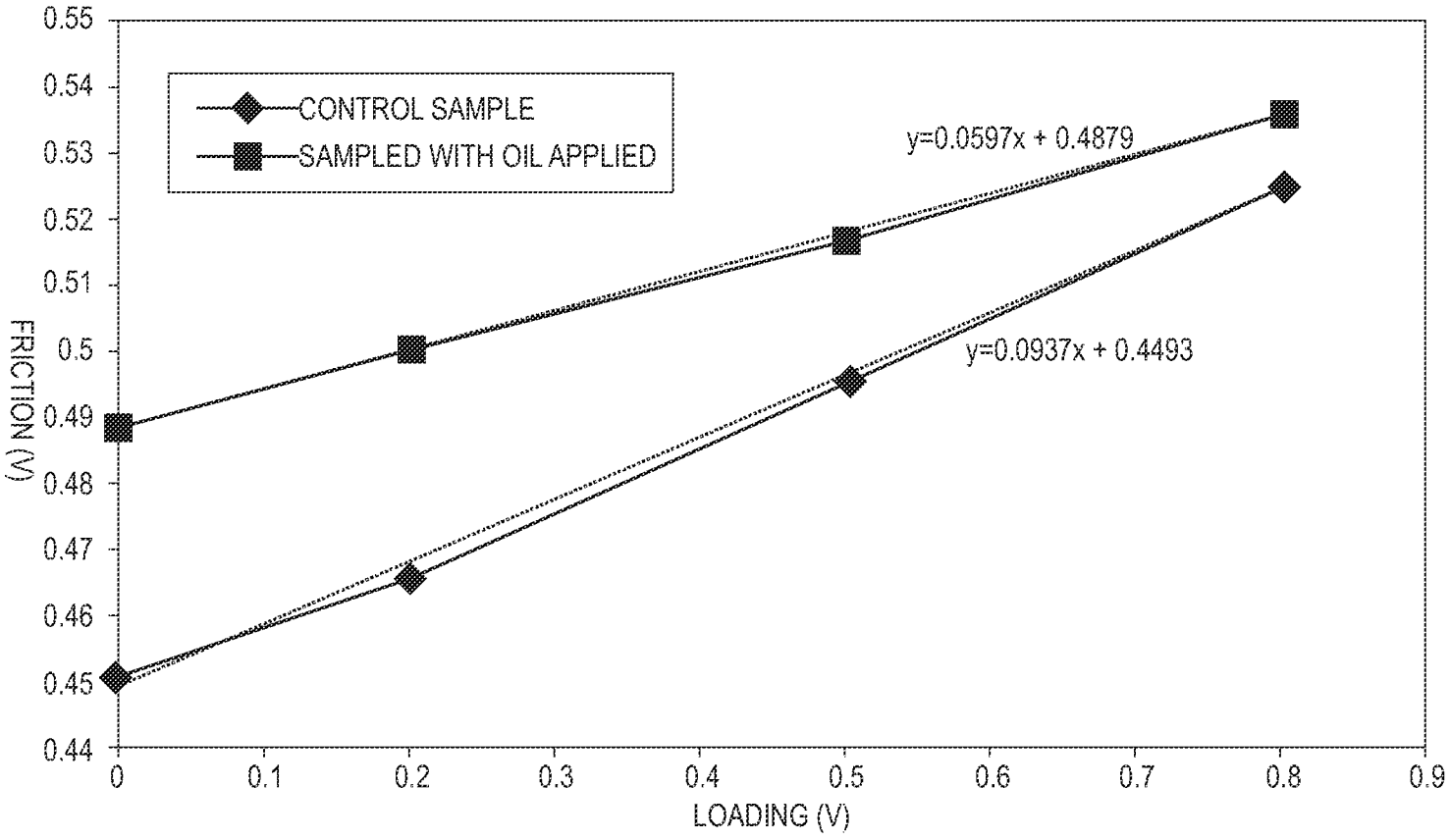
FIG. 10 is a graph showing the reduction in friction of the P/R using the liquid lubricant layer according to the present embodiments.

Friction decrease was also characterized through friction mapping of AFM on the P/R surface. The parameters to do friction map were to randomly choose a scanning area with size 4 um×4 um. Then the loading voltage proportional to the normal force) was increased at 4 different levels and the friction map was obtained. With the thin coating of oil layer as applied on P/R surface, the friction coefficient was reduced by about 36 percent based on the slopes of two linear curves in FIG. 10

Printing tests on a photoreceptor to compare the performance without and with applied layers of liquid paraffin oil were conducted. The BCR was spaced about 50 microns from the surface of the photoreceptor by wrapping copper tape at each end of the BCR. Without the applied liquid lubricant layer, the images of the printing test showed a variety of defects such as streaking and deletion. With the applied lubricant layer there were no defects.

It will be appreciated that variants of the above-disclosed and other features and functions or alternatives thereof, may be combined into other different systems or applications. Various presently unforeseen or unanticipated alternatives, modifications, variations, or improvements therein may be subsequently made by those skilled in the art which are also encompassed by the following claims.

What is claimed is:

1. An image forming apparatus comprising:

a) an imaging member having a charge retentive-surface for developing an electrostatic latent image thereon, wherein the imaging member comprises:
   a substrate, and
   a photoconductive member disposed on the substrate;

b) a charging unit for applying an electrostatic charge on the imaging member to a predetermined electric potential wherein the charging unit is adjacent to the photoconductive member and spaced a distance from the photoconductive member of from about 3 μm to about 300 μm; and c) a delivery member in contact with the surface of the photoconductive member, wherein the delivery member comprises an elastomeric matrix impregnated with a liquid lubricant wherein the delivery member applies a layer of liquid lubricant to the surface of the photoconductor wherein the layer of liquid lubricant has a thickness of from about 1 nm to about 15 nm during steady state operation of the image forming apparatus.

2. The image forming apparatus of claim 1, wherein the delivery member comprises:

a cylindrical support member, and an first layer comprising a elastomeric matrix and a liquid lubricant dispersed therein, the first layer disposed on the cylindrical support member wherein the liquid lubricant diffuses to an outer surface to provide the layer of liquid lubricant.

3. The image forming apparatus of claim 2, wherein the delivery member further comprises:

a second layer disposed on the first layer whereby the liquid lubricant can diffuse to the outer surface.

4. The image forming apparatus of the claim 1, wherein the charging unit comprises an outer layer having a volume resistance of about $10^3$ ohm-cm to about $10^{13}$ ohm-cm.

5. The image forming apparatus of the claim 1, wherein the charging unit comprises a spacing member contacting the surface of the photoconductive layer.

6. The image forming apparatus of claim 1, wherein the liquid lubricant comprises paraffin oil.

7. The image forming apparatus of claim 1, wherein the friction coefficient on the imaging member surface with the lubricant layer is reduced by about 36 percent to an imaging member having no lubricant layer.

8. The image forming apparatus of claim 1, wherein a direct current voltage with superposed alternating current element is applied on the charging unit.

9. The image forming apparatus of the claim 1, wherein the charging unit is driven by a driving device to rotate the charging unit such that a direction of a circumferential velocity of the charging unit is in the same direction as a direction of circumferential velocity of the photoconductive member.

10. An image forming apparatus comprising:

a) an imaging member having a charge retentive-surface for developing an electrostatic latent image thereon, wherein the imaging member comprises:
   a substrate, and
   a photoconductive member disposed on the substrate having a surface for supporting a toner image;

b) a charging unit for applying an electrostatic charge on the imaging member to a predetermined electric potential wherein the charging unit does not contact the surface the photoconductive member and spaced a distance from the photoconductive member of from about 3 μm to about 300 μm; and c) a delivery member in contact with the surface of the photoconductive member, wherein the delivery member comprises an elastomeric matrix impregnated with a liquid lubricant wherein the delivery member applies a layer of liquid lubricant to the surface of the photoconductor wherein the layer has a thickness of from about 1 nm to about 15 nm during steady state operation of the image forming apparatus.

11. The image forming apparatus of claim 10, wherein the delivery member comprises:

a cylindrical support member, and an first layer comprising a elastomeric matrix and a liquid lubricant dispersed therein, the first layer disposed on the cylindrical support member wherein the liquid lubricant diffuses to an outer surface to provide the layer of liquid lubricant.

12. The image forming apparatus of claim 11, wherein the delivery member further comprises;

a second layer disposed on the first layer whereby the liquid lubricant can diffuse to the outer surface.

13. The image forming apparatus of the claim 10, wherein the charging unit comprises an outer layer having a volume resistance of about $10^3$ ohm-cm to about $10^{13}$ ohm-cm.

14. The image forming apparatus of the claim 10, wherein the charging unit comprises a spacing member contacting the surface of the photoconductive layer.

15. The image forming apparatus of claim 10, wherein the liquid lubricant comprises paraffin oil.

16. An image forming apparatus, comprising:

a) an imaging member having a charge retentive-surface for developing an electrostatic latent image thereon, wherein the imaging member comprises:
   a substrate;
   a photoconductive layer disposed on the substrate; and
   a protective layer disposed on the photoconductive layer;

b) a bias charge roll for applying an electrostatic charge on the imaging member to a predetermined electric potential wherein the bias charge roll arranged to be adjacent to the photoconductive layer surface and spaced a distance from the protective layer of from 3 μm to 300 μm; and c) a delivery member in contact with the protective layer, wherein the delivery member comprises an elastomeric matrix impregnated with a liquid lubricant wherein the delivery member applies a layer of liquid lubricant to the surface of the imaging member wherein the layer has a thickness of from about 1 nm to about 15 nm during steady state operation of the image forming apparatus.

17. The image forming apparatus of claim 16, wherein the liquid lubricant comprises paraffin oil.

18. The image forming apparatus of the claim 16, wherein the charging unit comprises an outer layer having a volume resistance of about $10^3$ ohm-cm to about $10^{13}$ ohm-cm.

19. The image forming apparatus of claim 16, wherein the liquid lubricant applying unit comprises:

a cylindrical support member, an inner layer comprising a elastomeric matrix and a liquid lubricant dispersed therein, the inner layer disposed on the cylindrical support member; and an outer layer disposed on the inner layer whereby the liquid lubricant can diffuse to an outer surface.

20. The image forming apparatus of claim 16, wherein the liquid lubricant applying unit comprises:

a blade applicator comprising an elastomeric matrix and a functional material dispersed therein, and wherein the functional material diffuses from the elastomeric matrix to the surface.

* * * * *